United States Patent [19]

Cowger et al.

[11] Patent Number: 4,931,811

[45] Date of Patent: Jun. 5, 1990

[54] THERMAL INK JET PEN HAVING A FEEDTUBE WITH IMPROVED SIZING AND OPERATIONAL WITH A MINIMUM OF DEPRIMING

[75] Inventors: Bruce Cowger; Niels J. Nielsen; John H. Dion, all of Corvallis, Oreg.

[73] Assignee: Hewlett-Packard Company, Palo Alto, Calif.

[21] Appl. No.: 304,549

[22] Filed: Jan. 31, 1989

[51] Int. Cl.[5] ..... B41J 2/19

[52] U.S. Cl. ..... 346/140 R

[58] Field of Search ..... 346/140

[56] References Cited

U.S. PATENT DOCUMENTS 4,126,868 11/1978 Kirner ..... 346/140
4,368,478 1/1983 Koto ..... 346/140
4,630,758 12/1986 Mutoh ..... 346/140 X
4,771,295 9/1988 Baker ..... 346/140 X
4,794,409 12/1988 Cowger ..... 346/140

*Primary Examiner*—Joseph W. Hartary

[57] ABSTRACT

An ink jet pen having a main ink reservoir therein connected to a thin film printhead by way of a large diameter standpipe, wherein the diameter of an air accumulating section of the standpipe is sufficiently large to enable ink to pass through the standpipe despite the presence of air in the air accumulating section when the printhead is in operation. The large diameter air bubbles which form in the air accumulating section are easily deformed by suction force from the printhead and thus allow ink to pass through the standpipe between the air bubbles and the walls of the standpipe. This action enables the ink jet pen to operated continuously without undue suction on the standpipe which leads to depriming.

2 Claims, 2 Drawing Sheets

THERMAL INK JET PEN HAVING A FEEDTUBE WITH IMPROVED SIZING AND OPERATIONAL WITH A MINIMUM OF DEPRIMING

FIELD OF THE INVENTION

This invention relates generally to disposable ink jet pens for use with thermal ink jet printers. More particularly, this invention relates to such pens having large diameter feedtubes (or standpipes) for feeding ink from a reservoir to an ink jet printhead.

BACKGROUND ART

It is known to use feedtubes or standpipes as a preferred means for interconnecting an ink storage compartment of an ink jet pen with a thin film printhead (including orifice plate) which is mounted on one surface of the pen body housing. These feedtubes or standpipes serve to accommodate the necessary capillary draw of ink from the ink reservoir and through the firing chamber of the printhead to the print orifii thereof.

One example of such a feedtube is disclosed in U.S. Pat. No. 4,771,295 issued to Baker et al and assigned to the present assignee. Another example of such a feedtube is disclosed in U.S. Pat. No. 4,794,409 issued to Cowger et al and also assigned to the present assignee. Both of these U.S. Patents are incorporated fully herein by reference.

In recent experiments, it has been observed that standpipes which have a maximum diameter of the portion of the standpipe in which air accumulates below a certain minimum value will cause the ink jet pen to be greatly susceptible to depriming. In these so-called small standpipe ink jet pens, air bubbles that form in the standpipe, and particularly those that form and accumulate at the ink entrance or input opening of the standpipe, block the flow of ink to the ink jet printhead mounted at the other end of the standpipe to thus starve the printhead of ink and cause the pen to deprime. The printhead is simply incapable of generating enough pressure to pull ink past the air bubble in the standpipe, and the air bubble at the ink input opening of the small diameter standpipe seals off the flow of ink at this opening and causes the pen to deprime.

Historically, small diameter standpipes have been designed so that during pen priming, when there are relatively high flow rates of ink through the standpipe, high ink flow velocities are obtained through the standpipe and bubbles of air should theoretically be swept away. In practice, however, this rarely happens for the reason given above.

DISCLOSURE OF INVENTION

In accordance with the present invention, we have discovered that this problem of air bubble blockage of ink flow and pen depriming can be solved by making the diameter of the standpipe in the section thereof where air accumulates equal to or greater than a predetermined minimum value as calculated below so as to allow ink to be drawn past the air bubble in the standpipe. It is virtually impossible to sweep air bubbles out of a large bored standpipe, and this fact would seem to make such a design highly undesirable. However, a close examination reveals that when there is an air bubble located in a large bored standpipe and ink is pumped by the printhead at the small diameter end of the standpipe, the air bubble deforms slightly and allows the ink to slide down the standpipe wall. It has been observed in transparent body pens with large standpipes that page after page can be continuously printed over long periods of time without pen depriming, even when there is no visible ink in the standpipe.

Energy is required to deform the air bubble in the standpipe and thus increase its surface area. This energy term is inversely proportional to the standpipe radius. Also, the amount of air bubble deformation cannot be arbitrarily small, since the viscosity of the ink limits its velocity past the air bubble. With the ink flow rate determined by the operation of the printhead and being limited by the viscosity of the ink, a sufficient ink flow cross-section must be established at a suitable pressure to satisfy the printhead. The energy required to deform the air bubble is supplied by heightened suction at the printhead.

Further in accordance with the present invention, we have discovered that substantially all pen depriming will be eliminated if the minimum radius, r, for the standpipe section in which air accumulates satisfies the equation: $r/r_{nozzle} > 100$ where $r_{nozzle}$ is the radius of the orifii in the orifice plate of the thin film printhead of the ink jet pen.

The above features and advantages of this invention will become better understood from the following description of the accompanying drawings.

DETAILED DESCRIPTION

Figure 1:
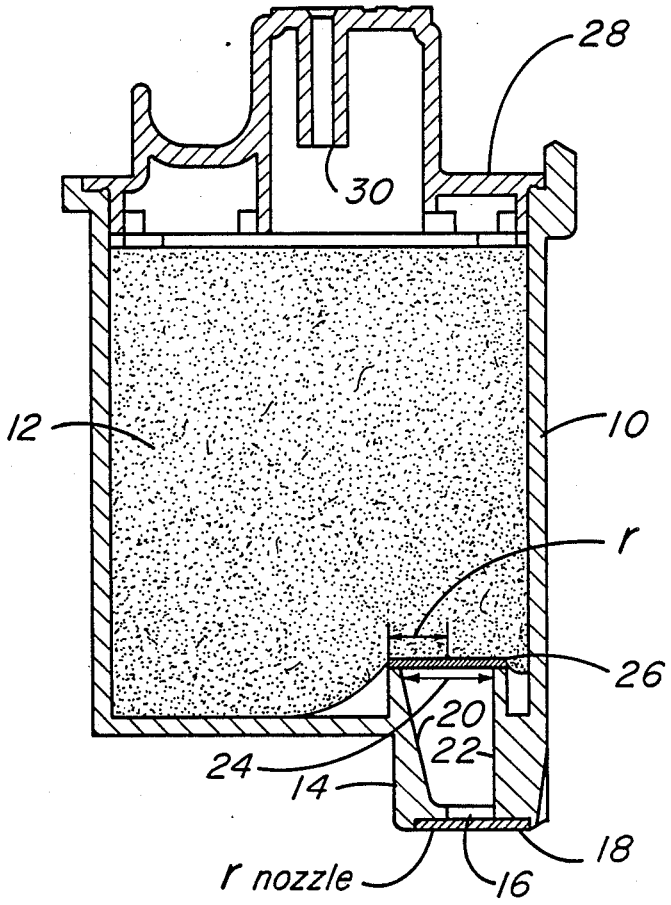
FIG. 1 is a schematic cross-sectional view of a thermal ink jet pen representing a preferred embodiment of the invention.

Referring now to FIG. 1, the thermal ink jet pen shown in this figure includes a main unitary pen body housing 10 of a suitable plastic material. The housing 10 will typically contain a reticulated polyurethane foam material 12 therein for storing ink in the manner described in the above identified Baker patent No. 4,771,295. This foam material provides the necessary capillary backpressure at the printhead of the pen to prevent ink from drooling out of the pen. This pen further includes an output or printhead support section 14 including a small output opening 16 adjacent to which is mounted a thin film thermal ink jet printhead 18. The printhead support section 14 has interior walls 20 and 22 which define the contour of the large diameter standpipe to be described, and the air accumulating section 24 is defined by a radius, r, calculated in the manner described below.

As seen in FIG. 1, the air accumulating section of the standpipe is the upper portion thereof just beneath the wire mesh filter 26. Air accumulates here in the section 24 when the pen is operating in the orientation shown in FIG. 1 and as a result of the wire mesh screen 26 trapping bubbles entering the standpipe from the printhead. That is, air bubbles enter the pen by way of the printhead and through the smaller or lower standpipe opening as shown in FIG. 1 and become trapped in the standpipe by the screen 26. This screen 26, whose absolute filtration rating is 25 micrometers, serves as a capillary stop to prevent air in the foam 12 from being drawn down into the standpipe.

The pen body construction shown in FIG. 1 further includes a cap 28 having an air vent tube 30 in the central portion thereof for supplying and replenishing air to the foam storage material 12 as ink is removed therefrom during an ink jet printing operation.

Figure 2:
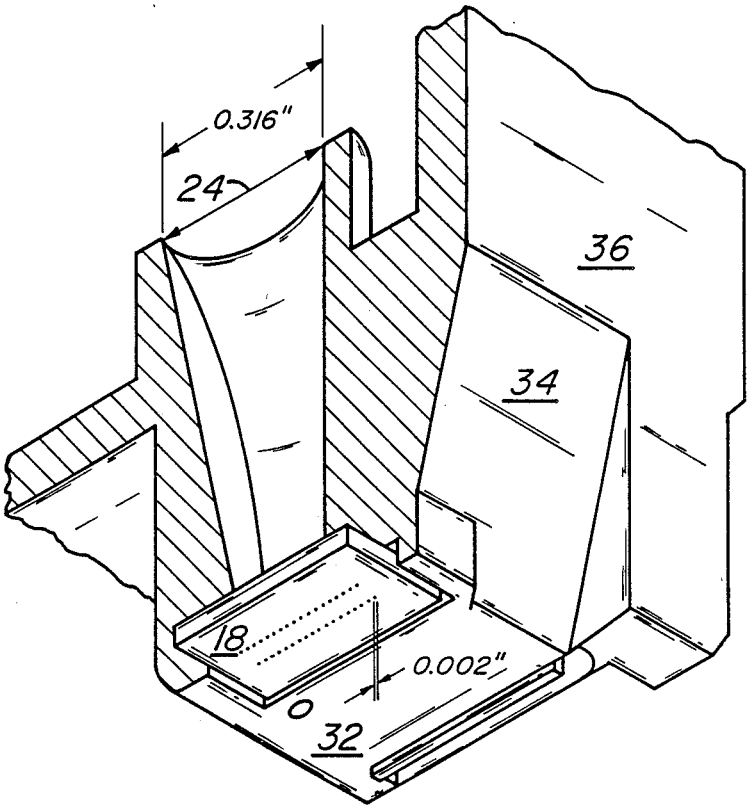
FIG. 2 is an enlarged fragmented isometric view of the standpipe and printhead portion of the ink jet pen of FIG. 1.

Referring now to FIG. 2, the printhead 18 has its output face or orifice plate approximately flush with the housing surface 32, and the flat end surface 32 intersects with the angled surface 34. These two adjacent surfaces are adapted to receive a flexible or FLEX circuit (not shown) which is used to supply power and drive signals to the printhead 18. This FLEX circuit may be further extended over the side wall 36 of the structure shown in FIG. 2 which corresponds to the right-hand housing wall of the pen body in FIG. 1.

To determine the minimum acceptable size for the air accumulating section 24 of the standpipe, two sets of five pens each were prepared with the dimensions given in Table I below.

TABLE I

| | LARGE DIAMETER STANDPIPE | SMALL DIAMETER STANDPIPE |
|---|---|---|
| STANDPIPE DIAMETER AT SCREEN FILTER 26 (inches) | 0.316 | 0.098 |
| AVERAGE DEPRIMES PER PAGE | 0.015 | >0.4 |

The small diameter standpipe had an obround (slot) shaped cross section whose critical dimension is the diameter given in Table I above. The length of the obround section was 0.18 inches.

The two sets of pens were otherwise identical, and the following construction details apply: Screens woven of stainless steel wire were heatstaked onto the top of each standpipe. Such screen material was obtained from the Pall Process Filtration Corporation of East Hills, New York, and Pall J-mesh material was used in this experiment. A piece of reticulated, polyurethane foam of 65 pores per inch porosity was placed into the ink storage reservoir 10 measuring 1.30 inches across, 1.60 inches high, and 1.00 inches deep, or into the paper as shown in FIG. 1. The foam was obtained from the Scotfoam Corporation of Eddystone, PA and was initially cleaned in Freon, although other fluorinated hydrocarbon solvents can also be used. The foam measured 1.65 inches across, 2.00 inches high, and 1,30 inches deep, which was the axis of felting. Prior to insertion into the pen, the foam's weight was doubled by saturating it with the ink described below, and then expelling all ink except an amount equal in weight to the foam's dry weight. This step aids in the eventual filling of ink into the foam.

The standpipe may be placed at different locations in the ink storage reservoir of the pen, but it must extend at least 0.10 inches into the foam, preferably 0.125 inches. Also, as measured in the plane of the filter screen 26, the standpipe should be no closer than 0.08 inches from any wall of the ink storage reservoir. The standpipe's vertical height was 0.408 inches with an 0.070×0.170 inch obround slot at its lower end from which ink exists.

A thin film printhead 18 was attached to the standpipe's exit opening 16, and the drop ejection orifii of the printhead measured 52 microns in diameter. Electrical interconnections were then made to the printhead using tape automated bond (TAB) bonding connections of the type described in U.S. Pat. No. 4,635,073 issued to Gary E. Hanson Jan. 6, 1987, assigned to the present assignee and incorporated herein by reference. The pens were then filled with 22 grams of a water based ink having 15% by weight of diethylene glycol (DEG) and 3% by weight of black dye (Food Black 2).

The pens were then printed until they were out of ink and the pages inspected for single or multiple nozzle deprimes. The results were tabulated and are shown in Table I above. Further experiments were performed with standpipes having a diameter with a dimension between the diameters given in Table I with no significant increase in the rate of deprimes with standpipes as small as 0.20 inches in diameter at the input opening 24.

The minimum standpipe radius which does not cause deprimes depends on the available suction of the drop ejection orifii of the printhead. As is well known to those skilled in the art, that suction is predicted by equation $p=2\sigma\cos\theta/r$ where p is the suction pressure on the ink at the printhead, $\sigma$ is the surface tension of the air-ink interface, $\theta$ is the contact angle between the ink and the walls of the orifii, and r is the radius of the orifii of the printhead. From these relationships it can be determined that the available suction of the printhead before depriming is inversely proportional to the radius of the drop ejection orifice. As the printhead orifii become smaller, so may the minimum acceptable diameter of the standpipe at the input opening 24, since the printhead is able to apply increasing suctions to deform the air bubble and flow ink past the bubble.

Thus, when considering the foregoing parameters and relationships together with the above tests, we have determined that the minimum acceptable radius for the large diameter opening 24 of the standpipe or feedtube must satisfy the following equation: $r/r_{nozzle}>r_{min}/r_{nozzle}$ which is calculated according to the above tests as $r_{min}/r_{nozzle}$=minimum diameter/nozzle diameter=0.20 inches/0.52 microns=0.20 inches/0.002 inches=100. Thus, $r/r_{nozzle}$22 100, and simllar relationships may be determined for pens having different orifice diameters or surface tensions.

The requirement for a minimum acceptable standpipe diameter for the opening 24 is not limited to pens which store ink in foam. Rather, this requirement applies equally well to pens containing ink in bladders or other means, such as for example the ink feed structure disclosed in the above U.S. Pat. No. 4,794,409 issued to Cowger et al. Thus, the broad scope of this invention covers the unique sizing of the ink feed standpipe or other equivalent air-accumulating chamber or ink passage member to make the standpipe or chamber air-tolerant.

We claim:

1. In combination, an ink jet pen having an ink reservoir and an ink jet thin film printhead and a standpipe interconnecting said reservoir and said printhead and having an air accumulating section adjacent said reservoir, said printhead has an orifice plate therein with orifii openings having a radius, $r_{nozzle}$, and said air accumulating section of said standpipe has a radius, r, which staisfies the equation: $r/r_{nozzle}>100$ and enables air bubbles to remain in said standpipe when said printhead is in operation whereby said air bubbles are deformed by the suction force generated by said printhead and allow ink to pass through said standpipe between said air bubbles and the walls of said standpipe and enable said ink jet pen to operate continuously without significant depriming due to air bubble blockage.

2. A thermal ink jet pen including an ink reservoir therein, and a thin film printhead interconnected to said reservoir by way of a standpipe, with said standpipe having an air accumulating section at the ink receiving end thereof and said thin film printhead including an orifice plate with a plurality of orifii therein of a known radius, $r_{nozzle}$, characterized in that the minimum acceptable radius, r, of said air accumulating section of said standpipe satisfies the equation $r/r_{nozzle} > 100$.

* * * * *

Dedication 4,931,811—Bruce Cowger, Niels J. Nielsen; John H. Dion, all of Corvallis, Oregon. THERMAL INK JET PEN HAVING A FEEDTUBE WITH IMPROVED SIZING AND OPERATIONAL WITH A MININUM OF DEPRIMING. Patent dated June 5, 1990. Dedication filed July 23, 1998, by the assignee, Hewlett-Packard Company.

Hereby dedicates to the public the entire term of said patent.

*(Official Gazette,* October 20, 1998)